United States Patent [19]

Bromage

[11] Patent Number: 4,741,524

[45] Date of Patent: May 3, 1988

[54] SORTING APPARATUS

[75] Inventor: David F. Bromage, Ross on Wye, United Kingdom

[73] Assignee: Xerox Corporation, Stamford, Conn.

[21] Appl. No.: 28,643

[22] Filed: Mar. 18, 1987

[30] Foreign Application Priority Data

Mar. 18, 1986 [GB] United Kingdom ..... 8606681

[51] Int. Cl.[4] ..... R65H 31/00

[52] U.S. Cl. ..... 271/208; 271/297; 271/305

[58] Field of Search ..... 271/208, 193, 297, 303, 271/305, 293

[56] References Cited

U.S. PATENT DOCUMENTS

| | | | |
|---|---|---|---|
| 3,709,492 | 1/1973 | Baker | 271/208 X |
| 3,744,790 | 7/1973 | Hoffmann | 271/64 |
| 3,957,264 | 5/1976 | Bach | 271/208 X |
| 4,228,996 | 10/1980 | Wilcox, Jr. | 271/297 |
| 4,307,432 | 12/1981 | Nishikawa | 361/221 |
| 4,494,166 | 1/1985 | Billings, et al. | 361/214 |
| 4,648,591 | 3/1987 | Osmera | 271/305 |

OTHER PUBLICATIONS

"Static Charge Elimination in the Semiautomatic Document Feed", Schell, IBM Technical Disclosure Bulletin, vol. 22, No. 3, Aug. 1979, p. 912.

"Collator Bin", Bach et al., IBM Technical Disclosure Bulletin, vol. 19, No. 1, Jun. 1976, pp. 12–13.

*Primary Examiner*—Richard A. Schacher

*Attorney, Agent, or Firm*—William A. Henry, II

[57] ABSTRACT

A sheet sorting apparatus for collating and distributing sheets received from a reproducing apparatus and adapted to reduce static charge from the sheets includes an array of sheet receiving bins defined by tray members. A transport means conveys sheets past each of the bins. Each bin has at its opening an electrically insulting diverter member that can be pivoted from an inoperative to an operative position to deflect and guide a sheet into the associated bin. Attached to the diverter member is an electrically conductive brush arranged to contact a sheet entering the bin and an electrically conductive track connecting the brush via conductive bearings to the grounded conductive frame of the sorter.

9 Claims, 3 Drawing Sheets

SORTING APPARATUS

Figure 1:
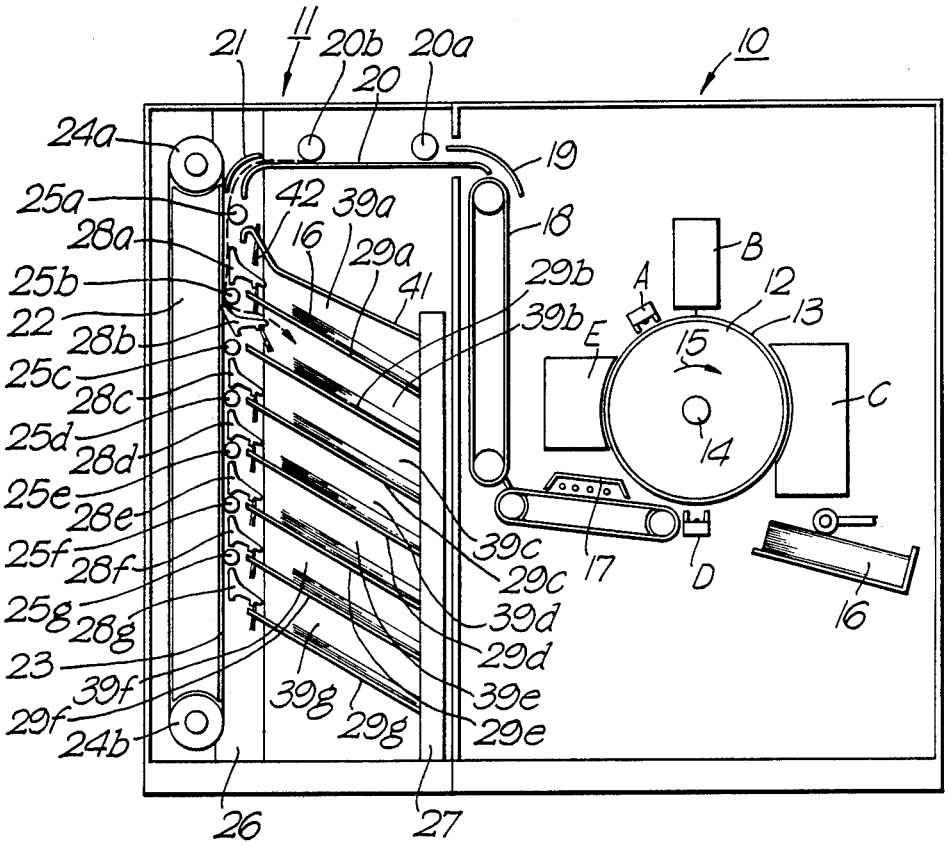

This invention relates to a sorting apparatus suitable for collating and distributing sheets received from a reproducing apparatus.

A variety of sorters for this purpose are known in the art and generally comprise a plurality of bins arranged in a row. The bins are usually defined by tray members for supporting the sheets received in the bin. In one type of sorter the tray members are comprised of parallel spaced apart members extending in a linear row.

Sheet distribution into the sorter bins may be accomplished in a number of ways. The common approach is to utilize a sheet transport to convey a sheet past the openings of the bins and deflection fingers to deflect and guide the sheet from the transport and into the associated bin as disclosed, for example in U.S. Pat. Nos. 4,228,996 and 3,744,790.

A problem which is encountered in sheet sorters generally is that static charge tends to accumulate in the sheets being fed to the sorter bins and if this is not eliminated or at least reduced sheets are inclined to be poorly stacked as they stick together within the bins and also sheets will tend to stick together in the complete sets when removed from the bins which is undesirable not least because the accumulated static charge in the stack can cause the operator to experience a static electric shock either during or even after unloading the stack from the sorter. The accumulation of charge can also lead to static discharge in the sorter which gives rise to electrical noise spikes and these can be sufficiently severe as to adversely affect the control systems of the reproducing apparatus and may even lead to shutdown of the machine.

Another consequence of accumulated static charge is that as sheets enter a bin they can be attracted and attach themselves to the roof of the bin causing an obstruction for subsequent sheets entering the bin. Lightweight sheets are particularly prone to this problem which can result in excessive jamming, machine shutdown, and damaged copies.

Accordingly, there is a need to provide a straightforward and low cost means of providing effective and reliable static reduction in sheet sorters generally.

IBM Technical Disclosure Bulletin Vol. 19, No. 1, June 1976, pages 12–13 discloses a sorter in which each bin has a non-conductive flexible flap extending from its underside into the subjacent bin for reducing the kinetic energy of and guiding the entering sheet. An electrically conductive tinsel is mounted behind each flap so as not to physically engage the entering sheet. The tinsel is constructed with sharp points. The electric field created between the charged sheet and these sharp points causes the air between the tinsel and the sheet to ionize thereby reducing the static charge on the sheet's surface.

It is also known in xerography to reduce or eliminate static electricity in a sheet at places other than the sorter. For example, in IBM Technical Disclosure Bulletin Vol. 22, No. 3, August 1979, page 912 there is disclosed a xerographic copier having a semi-automatic document feed input with a flexible conductive member disposed in the paper path which likely contacts the original document at numerous points across its width as it is transported from the platen to the exit pocket. The conductive member which acts as a static eliminator for the original documents is electrically grounded.

Moreover, U.S. Pat. No. 4,494,166 concerns static elimination in copy sheets immediately prior to exiting the main body of the copier. To this end there are provided at least two grounded carbon fibre brush static eliminators mounted in a plastic baffle assembly such that one brush contacts sheets moving through the machine while the other brush remains out of contact with the passing sheets. In U.S. Pat. No. 4,307,432 the use of out of contact brushes is disclosed for discharging paper within a photocopier.

According to the present invention there is provided a sheet sorting apparatus comprising a plurality of sheet receiving bins means for transporting a sheet past each of said bins, respective deflection means associated with each of said bins for selectively deflecting and guiding sheets from said transport means into the associated bin, and a respective static eliminator associated with each bin for reducing the static electricity of a sheet entering the bin, characterized in that each deflection means comprises an electrically insulating diverter member having attached thereto the static eliminator in the form of an electrically conductive brush arranged to contact a sheet entering a bin, and in that an electrically conductive track connects the brush to grounding (earthing) means.

A sorting apparatus in accordance with the invention enables the diverter member to be molded, e.g. as a single piece, from low-cost plastics material with the conductive brush fixed, e.g. screwed, thereto. The conductive brushes are earthed (grounded) via the conductive track which can be applied simply and cheaply as a conductive paint, thus providing an effective and reliable means of static reduction in a sorting apparatus at low cost.

Figure 2:
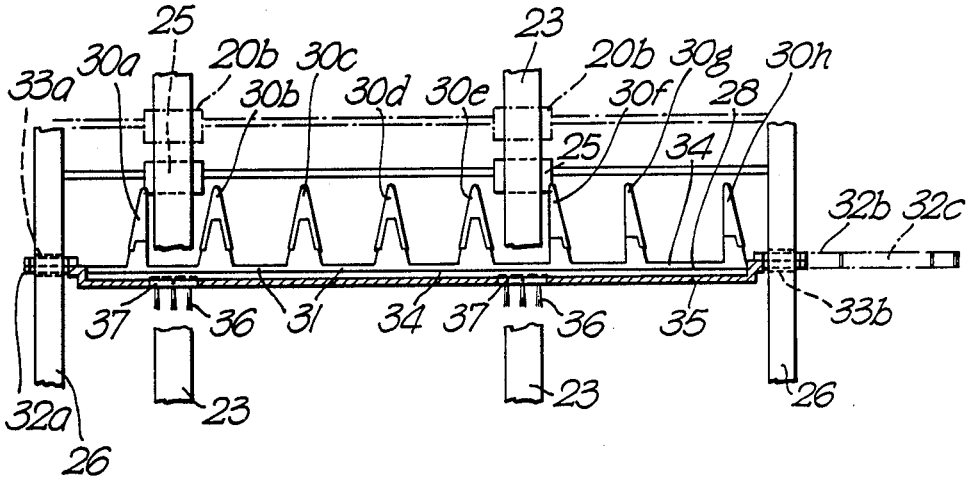
Figure 3:
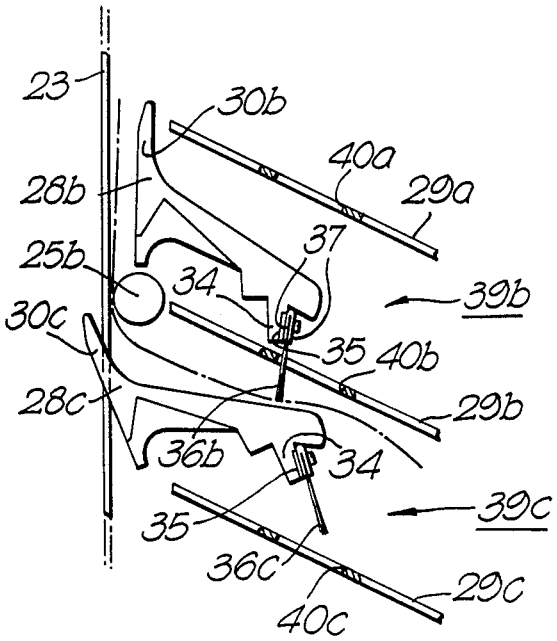
Figure 4:
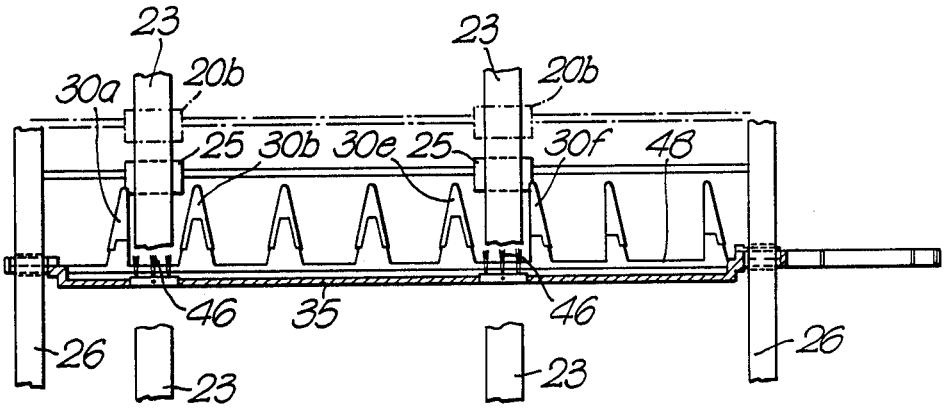
Figure 5:
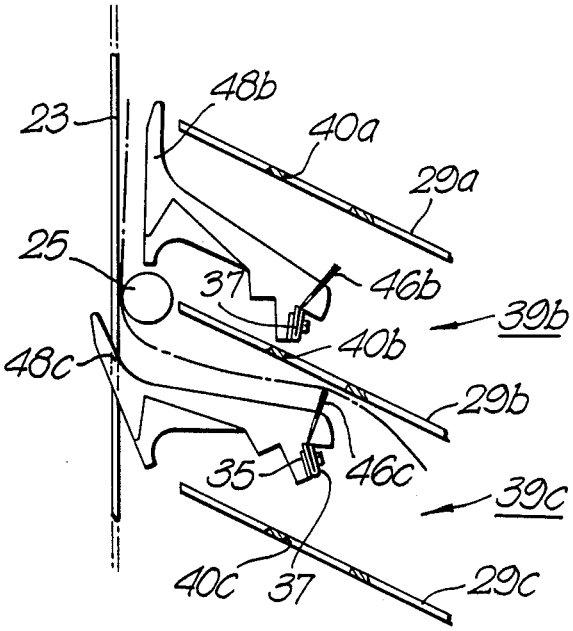

Embodiments of the invention will now be described, by way of example, with reference to the accompanying drawings in which:

FIG. 1 is a schematic side view of a reproducing machine and a sheet sorting apparatus in accordance with the invention, FIG. 2 is a front elevation (in the direction of sheet feed) of one of the diverter members of the sorter, FIG. 3 is an elongated schematic side elevation showing two adjacent diverter members and their associated bins, FIG. 4 is a front elevation of a modified diverter member for a sorter in accordance with the invention, and FIG. 5 is an enlarged schematic side elevation showing two such modified diverter members and their associated bins.

The same reference numerals are used to denote corresponding parts in the various figures.

Referring now to FIG. 1 there is shown by way of example an electrostatographic reproducing machine 10 which uses the improved sorting apparatus 11 of the present invention. The reproducing machine 10 depicted in FIG. 1 illustrates the various components utilized therein for xerographically producing copies from an original. Although the apparatus of the present invention is particularly well adapted for use with an automatic xerographic reproducing machine 10, it should become evident from the following description that it is equally well suited for use in a wide variety of electrostatographic systems and other reproducing machines and is not necessarily limited in its application to the particular embodiment shown herein.

The reproducing machine illustrated in FIG. 1 employs an image recording drum-like member 12, the outer periphery 13 of which is coated with a suitable photosensitive material. One type of suitable photoconductive material is disclosed in U.S. Pat. No. 2,970,906. The drum 12 is suitably journaled for rotation within a machine frame (not shown) by means of a shaft 14 and rotates in the direction indicated by arrow 15 to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet 16 of final support material such as paper or the like.

The practice of xerography is well known in the art, and is the subject of numerous patents and texts, including Electrophotography by Schaffert, published in 1965, and Xerography and Related Processes, by Dessauer and Clark, published in 1965. The various processing stations for producing a copy of an original are herein represented in FIG. 1 as blocks A to E.

Initially the drum 12 moves photoconductive surface through charging station A. In charging station A an electrostatic charge is placed uniformly over the photoconductive surface of the drum 12 preparatory to imaging. The charging may be provided by a corona generating device of a type described in U.S. Pat. No. 2,836,725.

Thereafter, the drum 12 is rotated to exposure station B where the charged photoconductive surface is exposed to a light image of the original input scene information, whereby the charge is selectively dissipated in the light exposed regions to record the original input scene in the form of a latent electrostatic image. A suitable exposure system may be of the type described in U.S. Pat. No. 3,832,057.

After exposure, drum 12 rotates the electrostatic latent image recorded on the photoconductive surface to development station C wherein a conventional developer mix is applied to the photoconductive surface of the drum rendering the latent image visible. A suitable development station is disclosed in U.S. Pat. No. 3,707,947. The patent describes a magnetic brush development system utilizing a magnetizable developer mix having carrier granules and toner colorant. The developer mix is continuously brought through a directional flux field to form a brush thereof. The electrostatic latent image recorded on the photoconductive surface is developed by bringing the brush of developer mix into contact therewith.

The developed image on the photoconductive surface 13 is then brought into contact with the sheet 16 of final support material within a transfer station D, and the toner image is transferred from the photoconductive surface to the contacting side of the final support sheet. The final support material may be paper, plastics, etc. as desired. After the toner image has been transferred to the sheet of final support material the sheet with the image thereon is advanced to a suitable fuser 17 which coalesces the transferred powder image thereto. One type of suitable fuser is described in U.S. Pat. No. 2,701,765.

Although a preponderance of the toner powder is transferred to the final support material 16, invariably some residual toner remains on the photoconductive surface after transfer. The residual toner particles remaining on the photoconductive surface after transfer are removed from the drum 12 as it moves through cleaning station E. Here the residual toner particles are first neutralized and then mechanically cleaned from the photoconductive surface by conventional means as, for example, the use of a resiliently based knife blade as set forth in U.S. Pat. No. 3,660,863.

It is believed that the foregoing description is sufficient to illustrate the general operation of an automatic xerographic copier which can use a sorter of the present invention. Unless otherwise specified or shown, shafts and other members are suitably supported in appropriate machine frames by any desired conventional means.

After a sheet exits from the fuser it is transported vertically upwards by a sheet transport 18 of conventional design and guided round a 90° path by guide 19 onto horizontal platform 20 where the lead edge of the sheet enters a first nip formed between a pair of driven input rolls **20*a* and the surface of platform 20. The sheet is thus conveyed upon the platform 20 towards a second nip formed between a second pair of driven input rolls 20*b* and the platform 20. The lead edge of the sheet enters the second nip before the trail edge exits the first nip and thus the sheet is conveyed towards guide 21 which guides the sheet downwards round the 90° path onto a vertical sheet transport 22 for directing the sheet vertically downwards past the openings of sheet receiving bins 39*a*, 39*b*, . . . 39*f*, 39*g***. *As is well known the transport 22 may comprise several belts 23 entrained about a drive roll 24a* and an idler roll **24*b* located directly beneath the drive roll 24*a*. In the present drawings only two such belts 23 are shown and these are located to be in line with feed roll pairs 20*a* and 20*b***.

In the sorting arrangement shown the sheets 16 which exit from the reproducing machine 10 are image face up, but they are delivered into the sorter bins 39 image face down.

The sorter 11 comprises a plurality of sheet receiving bins **39*a* . . . 39*g* defined by tray members 29*a* . . . 29*g* in a vertically stacked, mutually parallel arrangement with each tray member being inclined downwardly away from the sheet transport 22. The upper- and lowermost ends of the trays 29 are secured in electrically conductive frame members 26 and 27. The frame members are typically made of mild steel or stainless steel. In FIG. 1, seven bins 39** are shown but this is merely exemplary and there may be more or less bins depending on the sorting capability required.

The sheet transport 22 comprises a pair of idler rolls **25*a*, 25*b*, . . . 25*g* located respectively at each opening of the bins 39*a*, 39*b*, . . . 39*g*. The idler rolls 25 are spring loaded against the transport belts 23 so that a sheet can be conveyed thereby. It is noted that, at each bin opening, one idler roll 25 is provided against each belt 23. Hence, in the present example two idler rolls 25 are present at each bin opening (see FIG. 2), one being associated with each of the two belts 23**.

At the opening of each bin **39*a* . . . 39*g* in the vicinity of the idler rolls 25 of the sheet transport 22 there is an associated diverter member 28*a* . . . 28*g*. As can be seen more clearly in FIG. 2, each diverter member 28 comprises a plurality of upwardly directed deflection fingers 30*a*, 30*b*, . . . 30*h* extending across the width of the sorting apparatus. The profile of deflection fingers is such as to present on their upper side a curved guide surface for selectively deflecting a sheet into the associated bin as described hereinafter. The deflection fingers 30 are formed integrally with a connection bar 31 having shaft extension portions 32*a*, 32*b* of circular crosssection rotatably mounted in electrically conductive bearings in apertures 33***a*, 33*b* in the frame members 26. Shaft extension portion 32*b* is longer than portion 32*a* and has a flat surface 32*c* for engagement with drive means (not shown) for pivoting the whole diverter member 28 between an operative and inoperative position as discussed in more detail below. Suitably the selected diverter member 28 may be actuated into the operative position by means of a solenoid in known manner. It is noted here that only one diverter member is actuated at any given time and all the other diverter members are biased by means of a compression spring (not shown) to the inoperative position so as to provide an unobstructed path for a copy sheet to travel to the required bin. The diverter member 28 is made of electrically insulating plastics material, for example styrene acrylonitrile with 30% glass reinforcement and is preferably formed in a single piece by molding.

The bar 31 has a depending rib 34 extending the full width of the bar 31. Applied to the rib 34 is a track 35 of conductive paint, for example the paint coded MO/24/25/00/00/SB/777 available from Nord West Chemie, F A CUHMICHEL, 3000 Hanover, West Germany. The track 35 extends the full width of the rib 34 and onto the shaft extension portions 32*a*, 32*b* thus making electrical connection with the frame 26 via the electrically conductive bearings in the apertures 33*a*, 33*b*. In FIG. 2 the conductive track 35 is denoted by cross hatching for ease of identification.

Fastened to the rib 34 are two sets of electrically conductive brushes 36 each comprising a group of three similar brushes of carbon fibre bristles sandwiched between a pair of metal plates 37 which are screwed to the rib 34 over the conductive track 35. In this way there is a continuous conductive path from the bristles of the brushes 36 via the plates 37 and conductive track 35 to the frame 26. Conventionally the frame is connected to earth (ground) potential. In FIG. 2, the transport belts 23 are shown cut-away in the vicinity of diverter member 28 so as not to obscure the brushes 36. In reality the belts 23 are of course continuous. As shown in FIG. 2, the two groups of brushes 36 are arranged in line with the idler rolls 25 and the belts 23 at the entrance of the sorter. It is advantageous for the brushes to be in line with the feed rolls 20*b*, the idler rolls 25, and the belts 23 because these are responsible for localised strips of static charge buildup on the sheets and it is these localized strips which are most in need of static elimination. In FIG. 2 these feed rolls 20*b* are included, being denoted by a broken line merely to indicate their lateral position. As can be seen from FIG. 1, this is not their true vertical position relative to the diverter member.

FIG. 3 shows the inoperative and operative positions of two adjacent diverter members 28*b* and 28*c* respectively associated with and located at the openings of bins 39*b* and 39*c*. Diverter member 28*b* is in the inoperative position and has upstanding fingers 30*b* parallel and slightly spaced apart from the belt 23 of vertical transport 22. In this position the brushes 36*b* extend through apertures 40*b* in the tray member 29*b* and into the bin 39*c* below. The sheet path is denoted by the broken line and thus it can be seen that with the diverter member in the inoperative position a sheet is conveyed past the opening of associated bin 39*b*. However, diverter member 28*c* is shown pivoted into the operative position where the fingers 30*c* are tilted backwards and extend between adjacent belt 23 of vertical transport 22 to present their upper curved guide surface to the paper path thus deflecting a sheet into the associated bin 39*c*, as shown by the broken line. As the sheet approaches the forward edge of the diverter member 28*c* it is swept by the bristle tips of brushes 36*b* from the diverter member 28*b* directly above. The brushes thus act as a static eliminator allowing static charge which has built up in the sheet to leak away to earth (ground) along the continuous conductive path provided by the conductive brushes, the conductive paint track, conductive bearings, and conductive frame which, as mentioned previously, is connected to earth (ground) potential. It will be appreciated that the actuated diverter member, in this case diverter member 28*c*, provides a non-conductive surface opposite the brush depending from the diverter member directly above, in this case brush 36*b*, which is important for effective static elimination.

As can be seen in FIG. 1, the array of bins 39 is provided with a cover plate 41 defining the top of uppermost bin 39*a* and having fixed conductive brushes 42 extending into the opening of bin 39*a* so that when the diverter member 28*a* is pivoted into the operative position to guide sheets into bin 39*a* it is the conductive brush 42 which sweeps against the sheet as it enters the bin.

It is to be noted that in the arrangement described thus far the brushes contact the upper surface of the sheets entering the bins. From the foregoing description it will be evident that the upper surface is the non-image side of the sheet. A modified form of diverter member 48 for image-side brush contact is shown in FIGS. 4 and 5 wherein the carbon fibre brushes 46 are arranged in an upwardly inclined direction. It is noted that in FIG. 4 the transport belts are again cut-away in the vicinity of the diverter member 48 so as not to obscure the brushes 46. In this case the brushes fastened to a diverter member of a particular bin extend into that same bin rather than the bin below. Thus, as shown in FIG. 5, when a diverter member 48*c* is in the actuated position it is effective to deflect a sheet into the associated bin 39*c* and it is the brush 46*c* of that same deflector member 48*c* which sweeps against the underside, that is to say the image side, of a sheet entering the bin 39*c*, thus providing optimum static elimination. It is noted that the brushes are provided at the suitable angle so as to prevent the sheets entering the bin stubbing against the bristles. Also, although in this embodiment the tray members 29*a*, . . . 29*g* have apertures 40*a* . . . 40*g* respectively exactly as in the previous embodiment, it has to be noted that they perform a quite different function in this case, being located such that the brush 46*c* on a particular diverter member 48*c* aligns with the aperture 40*b* of the tray member 29*b* above when the diverter member 48*c* is in its operative position. Without the apertures the bin plates, being conductive, would present an earth plane opposite the carbon fibre brushes, which would result in ineffective static elimination.

It will be evident to the person skilled in the art having regard to the embodiments described above that various modifications may be made within the scope of the invention specified in the appended claims.

What is claimed is:

1. A sheet sorting apparatus comprising a plurality of sheet receiving bins, means for transporting a sheet past each of said bins, respective deflection means associated with each of said bins for selectively deflecting and guiding sheets from said transport means into the associated bin, and a respective static eliminator associated with each bin for reducing the static electricity of a sheet entering the bin, characterized in that each deflection means comprises an electrically insulating diverter member having said static eliminator attached thereto in the form of an electrically conductive brush arranged to contact a sheet entering a bin, and in that an electrically conductive track connects said brush to grounding (earthing) means.

2. A sheet sorting apparatus as claimed in claim 1, wherein the grounding (earthing) means comprises an electrically conductive frame connected to ground (earth) potential, within which frame said bins are supported.

3. A sheet sorting apparatus as claimed in claim 2, wherein each diverter member comprises a plurality of deflection fingers fixedly mounted on a shaft which is rotatably mounted in electrically conductive bearings in the frame, said electrically conductive track extending between said deflection fingers along said shaft and electrically contacting said frame via said electrically conductive bearings.

4. A sheet sorting apparatus as claimed in claim 1, wherein said conductive track is a conductive paint track on the surface of the diverter member.

5. A sheet sorting apparatus as claimed in claim 1, wherein the diverter member comprises a one-piece molded plastics member.

6. A sheet sorting apparatus as claimed in claim 5, wherein said brush on each diverter member depends through an aperture in the associated bin and extends into the adjacent bin so as contact a sheet entering said adjacent bin.

7. A sheet sorting apparatus as claimed in claim 5, wherein said brush on each diverter member is arranged to contact a sheet entering the associated bin.

8. A sheet sorting apparatus as claimed in claim 5, wherein each diverter has at least one group of several electrically conductive brushes attached thereto, each such group being in line with a feed roll for feeding sheets to the transport means.

9. A sheet sorting apparatus as claimed in claim 8, wherein said brushes comprise carbon fibre bristles.

* * * * *